US006193034B1

(12) United States Patent
Fournier

(10) Patent No.: US 6,193,034 B1
(45) Date of Patent: Feb. 27, 2001

(54) SPORTS BAG

(76) Inventor: Marc Fournier, 290 Labine Street, Azilda, Ontario (CA), P0M 1B0

( * ) Notice: Subject to any disclaimer, the term of this patent is extended or adjusted under 35 U.S.C. 154(b) by 0 days.

(21) Appl. No.: 09/423,621

(22) PCT Filed: Apr. 9, 1998

(86) PCT No.: PCT/CA98/00338

§ 371 Date: Nov. 15, 1999

§ 102(e) Date: Nov. 15, 1999

(87) PCT Pub. No.: WO98/52439

PCT Pub. Date: Nov. 26, 1998

(30) Foreign Application Priority Data

May 16, 1997 (CA) ..... 2205607

(51) Int. Cl.[7] ..... A45C 7/00; A45C 9/00

(52) U.S. Cl. ..... 190/107; 190/15.1; 190/109; 383/4; 206/289

(58) Field of Search ..... 190/15.1, 107, 190/1, 108, 109, 110, 111; 206/289; 383/4

(56) References Cited

U.S. PATENT DOCUMENTS

| | | | | |
|---|---|---|---|---|
| D. 328,670 | * | 8/1992 | Fluehr | D3/283 |
| 2,254,578 | * | 9/1941 | O'Brien | 190/107 |
| 3,173,465 | * | 3/1965 | Pastini | 190/107 |
| 3,994,372 | * | 11/1976 | Geller et al. | 190/107 |
| 4,738,547 | | 4/1988 | Brown . | |
| 4,753,329 | | 6/1988 | Choy . | |
| 4,753,342 | | 6/1988 | Pulichino, Jr. . | |
| 4,859,084 | | 8/1989 | Kaumeyer . | |
| 4,942,948 | * | 7/1990 | Vickers | 190/107 |
| 5,002,401 | | 3/1991 | Blackman . | |
| 5,918,711 | * | 7/1999 | Godshaw | 190/107 |
| 6,076,485 | * | 6/2000 | Peeples et al. | 190/107 |

FOREIGN PATENT DOCUMENTS

| | | |
|---|---|---|
| 1275389 | 10/1990 | (CA) . |
| 1278550 | 1/1991 | (CA) . |
| 2018895 | 12/1991 | (CA) . |
| 2091612 | 9/1994 | (CA) . |
| 0 649 613 | 4/1995 | (EP) . |
| 2110661 | 4/1995 | (CA) . |
| 2 580 910 | 10/1986 | (FR) . |

* cited by examiner

*Primary Examiner*—Allan N. Shoap
*Assistant Examiner*—Tri M. Mai
(74) *Attorney, Agent, or Firm*—Jacobson, Price, Holman & Stern, PLLC

(57) ABSTRACT

The sports bag of the present invention is preferably used for the transport and storage of hockey equipment. The bag comprises a base to which side walls and end walls are hingedly connected. The bag can occupy a planar configuration, when the base, side walls and end walls are co-planar, or in a closed configuration, when the walls are hinged upwardly from the base and connected to each other, preferably by zippers, at adjacent edges to define an interior space. Pockets disposed on the interior surfaces of the bag are made of material, such as nylon mesh, which allows air to circulate through the pockets, expediting evaporation of moisture from an item of sports equipment or clothing inside a respective pocket. In the planar configuration, the bag may be suspended vertically from a hanger to minimize the space required for air-drying of the sports equipment items in the pockets.

21 Claims, 4 Drawing Sheets

SPORTS BAG

FIELD OF THE INVENTION

This invention relates to bags used for transport and storage of items of sports equipment and clothing, which facilitate organization of the items and evaporation of moisture therefrom, and particularly to bags for transporting hockey equipment.

BACKGROUND

Hockey equipment is conventionally transported and stored in a duffle bag. Although a duffle bag allows for compact containment of the hockey equipment, it also has the disadvantage that the individual items of equipment are stored in an unorganized fashion therein, often requiring an individual to rummage through the contents to retrieve a particular item.

Another disadvantage of the duffle bag is that perspiration moisture-laden clothing and equipment must be removed from the bag to facilitate optimal moisture evaporation and to avoid mildew formation. Once formed, mildew may cause rot, necessitating replacement of clothing or equipment items due to physical deterioration and unpleasant odour.

To expedite evaporation, individual items of clothing and equipment are often strewn about an area, leaving such an area in unsightly disarray. When re-packing the dried equipment or clothing items into the duffle bag, it is possible to unknowingly omit items or to erroneously pack the wrong items if more than one person's clothing and equipment are strewn about the same general area. When athletes are travelling on a road trip or to a tournament, they often stay in hotel rooms with inadequate space for the drying of sports equipment.

Bags and other types of carriers which open to provide a planar surface with integral pockets are known, for example, garment bags such as those described in U.S. Pat. No. 4,753,342 and Canadian Patent Application No. 2,169,994. Other bags designed to hold various tools or household items are also known, such as those described in U.S. Pat. Nos. 4,738,547 and 5,002,401. However, these prior designs do not address the particular needs of the hockey player or other individual transporting bulky sporting equipment and clothing (hereinafter referred to simply as sports equipment).

Prior art designs have addressed the deficiencies of the conventional duffle bag style of hockey bag in attempts to facilitate moisture evaporation or to improve the organization of the contents through compartmentalization.

Canadian Patent Application No. 2,018,895 (Collins) discloses a hockey equipment bag comprising interior compartments for separating articles of clothing and equipment. The bag has two main storage compartments hingedly connected and secured together with a zipper or other closure means. However, in the opened position, although certain individual items of clothing or equipment are segregated, other items such as wet articles are combined within a compartment, requiring eventual removal for moisture evaporation to occur.

Canadian Patent Application No. 2,091,612 (Dicaire) discloses a garment bag which may be transformed into a drying device. An interior rigid frame comprising three hingedly connected sections corresponding to the two sides and the base of the bag, is integral to the interior of the bag and is surrounded by and removable from the flexible exterior envelope of the bag. Mesh pockets are attached to the rigid frame, and a hanger is supplied on one end of the frame to allow the frame to hang vertically above the ground. Articles of clothing or equipment can be separately stored in distinct pockets to allow for evaporation of moisture. Although this garment bag allows for compartmentalized storage of various articles, the frame makes the bag bulky and rigid which is a disadvantage when, for example, the bag is being transported in a vehicle which has marginally adequate space, and compression of the bag is required. Additionally, although the interior frame allows for vertical hanging above the ground, inconveniently, detachment from the flexible exterior envelope is required prior to hanging.

Canadian Patent No. 1,278,550 (Dickson et al.) discloses a storage bag intended for use in the storage or transport of hockey or football equipment, containing inner mesh pockets to readily allow ambient air to evaporate moisture from objects within the pockets. This storage bag has one main opening, similar to the top end opening of a duffle bag and differing therefrom in that the opening extends down the two end sides of the bag to the base of the bag so that the bag is hingedly openable, similar to a conventional suitcase. The bag may be hung vertically from at least one hook on an end side to allow drying of the contents contained therein. However, unless the bag is hung from a plurality of points along an end side, access to the contents when the bag is in an opened position becomes cumbersome.

Canadian Patent No. 1,275,389 (Baker) teaches a sports equipment bag which opens to a planar conformation to permit evaporative drying of equipment stored therein. The bag has a plurality of straps and pockets to retain the equipment. However, in order to hang vertically, the bag must be suspended from a plurality of points along a longitudinal edge of the bag. This design is impractical since a great deal of space is occupied in order to adequately space the hooks apart. Additionally, if an athlete is on a road trip, the reduced availability of space and hooks limits the usefulness of the invention.

U.S. Pat. No. 4,753,329 (Choy) described a multi-compartmented bag which facilitates the segregation of moisture-laden and dry clothing or equipment. Water-proof compartments ensure that transfer of moisture between compartments is avoided. Disadvantageously, the contents of the compartments must be removed to allow moisture evaporation therefrom.

Canadian Patent Application No. 2,110,661 (Clement) describes an equipment bag having a removable inner mesh sack. The mesh sack is readily permeable to ambient air, thus allowing drying of the clothing or equipment contained therein, but for optimal moisture evaporation, the contents of the mesh bag would still require removal and separation. Additionally, the contents of the inner mesh bag remain unorganized, and to recover any particular object from the inner mesh sack, rummaging through the contents of the sack is required.

OBJECTS OF THE INVENTION

An object of the present invention is to provide a sports bag which obviates or mitigates the deficiencies of the prior art.

Another object of the invention is to provide a sports bag which facilitates organization of the sports equipment to be stored and transported therein.

A further object of the invention is to provide a sports bag which promotes evaporative drying of the equipment contained therein without removal of the equipment from the bag, and which may be easily suspended vertically from a hook without occupying excessive space.

SUMMARY OF THE INVENTION

According to the present invention, there is provided a sports bag for promoting evaporative drying of items contained therein, the sports bag comprising a) a rectangular base;

b) first and second side walls hingedly connected to respective opposite side edges of the base;

c) first and second end walls hingedly connected to respective opposite end edges of the base;

wherein the side walls and end walls are formed of a flexible material and, in a first configuration, the base, side walls and end walls are co-planar, and, in a second configuration, the side walls and end walls extend upwardly from the base, and edges of the end walls are joined to adjacent edges of the side walls via co-operating separable fastening means;

d) a plurality of pockets disposed- on interior surfaces of the base and side walls, the pockets comprising a moisture- and air-permeable material which permits air to circulate therethrough;

e) top closure means to releasably connect distal edges of the side walls, thereby enclosing the interior surface of the bag when in the second configuration; and f) a hanger mechanism connected to the distal edge of the first side wall, the hanger mechanism having a first rigid member adapted to extend along the distal edge of the first side wall, and a centrally located hanger loop;

whereby the sports bag may be suspended vertically by the hanger loop when in the first configuration to allow for evaporative drying of items within the pockets.

Preferably, wherein the hanger loop is connected to the first rigid member. Additionally, the invention may include a second rigid member adapted to extend along the distal edge of the second side wall. The rigid members may optionally be telescopically retractable.

Preferably, the side walls are rectangular in shape and the end walls have three sides, two of which may be curved. The co-operating separable fastening means used to join adjacent edges of the side walls to the end walls is preferably a zipper, but may also be any other type of fastener such as velcro. The top closure means may be any type of co-operating separable fastener extending along the distal edge of the side walls, such as a zipper or a velcro flap.

The bag may also comprise carrying means disposed on the exterior surface of the bag to facilitate hand-held transport of the bag when in the second configuration. The carrying means preferably comprises two flexible loops attached to respective side walls of the bag. A separable shoulder strap may also be provided on the bag, the length of which may optionally be adjustable.

The pockets are preferably formed from mesh nylon material and are individually shaped and sized to retain a specific item of equipment or clothing. The pockets are generally transparent and may be labelled to denote the specific item to be retained therein, or may be coded in another way to ensure items are stored in appropriate pockets. The pockets are preferably openable at the edge nearest the distal edge of the first side wall, and may be closable with a cooperating separable fastener such as velcro or a zipper. An outer pocket may be disposed on the exterior of a side wall, for storage of miscellaneous items.

An advantage is that the vertical hanging of the bag when in a planar configuration does not impart mess and disarray to the surrounding area and is adequately compact to allow drying in a limited space. The hanging of the bag via a hanger loop allows convenient hanging from a single point. The rigid member distributes the weight of the bag across the entire first distal edge, thereby minimizing the chance of the bag ripping while it is suspended vertically.

Another advantage of the invention is that sports equipment and clothing can be organized in the sports bag so that each item has a corresponding compartment, and thus all of the equipment items can readily be viewed. If an item is missing, its absence is readily detected via the presence of an empty pocket. The potential for losing, forgetting or misplacing equipment is virtually eliminated.

A further advantage of the invention is that moisture-laden clothing and equipment need not be removed from the pockets to expedite drying, since ambient air can circulate through the pocket material when the bag is opened to a planar configuration.

DETAILED DESCRIPTION OF THE INVENTION

Figure 1:
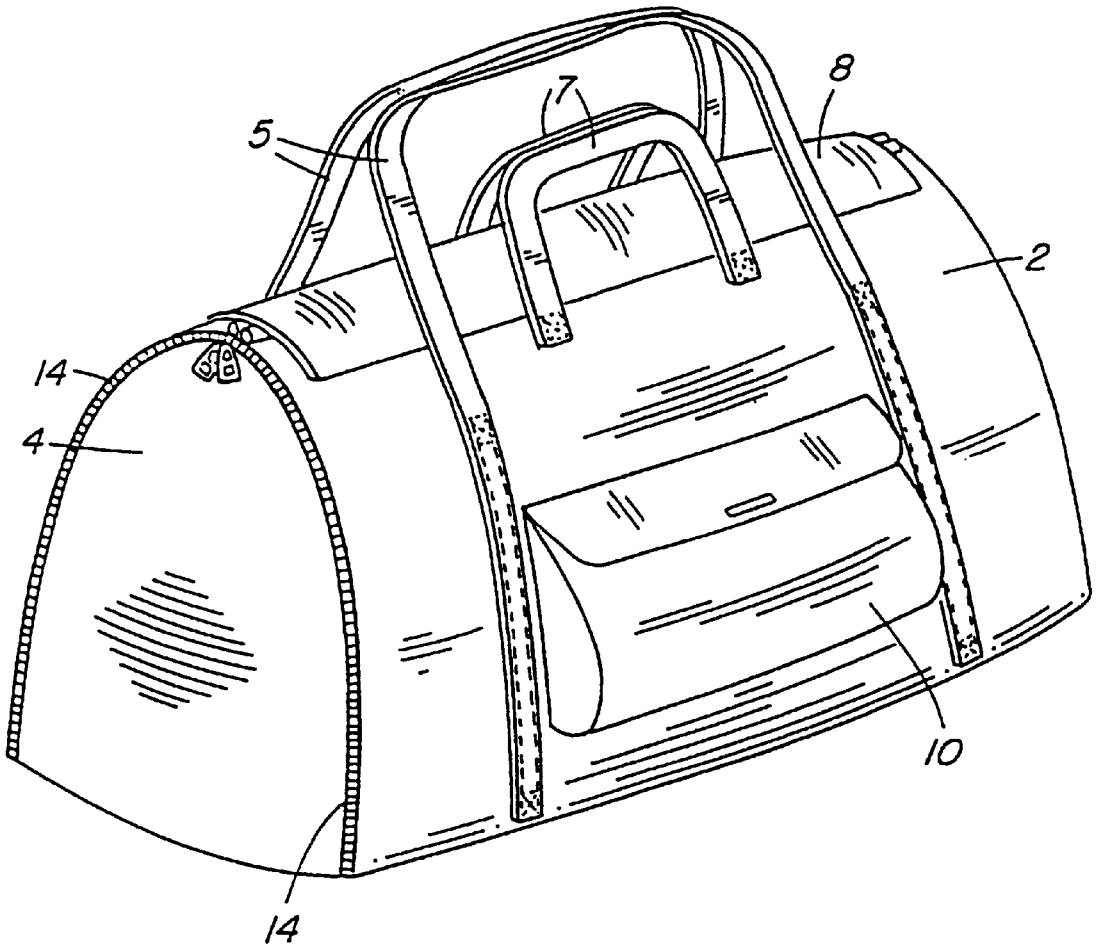
FIG. 1 is a perspective view of a sports bag in the closed configuration according to a first embodiment of the invention.

In the sports bag shown in FIG. 1, side walls (2) and end wails (4) are hinged upwardly from a base (1) (see FIG. 3) and are connected together by zippers (14) at the adjacent edges. Small handles (7) and large handles (5), comprised of loops of a flexible material, are connected to the side walls (2) of the bag. A velcro closure (8) with co-operating portions disposed on respective distal edges of the side walls is used to enclose the interior of the bag. A pocket (10) is placed on the exterior of a side wall (2) of the bag. In this embodiment, the larger handles may optionally be used to carry the bag over the shoulder. The end walls are curved at the edges which abut the side walls.

Figure 2:
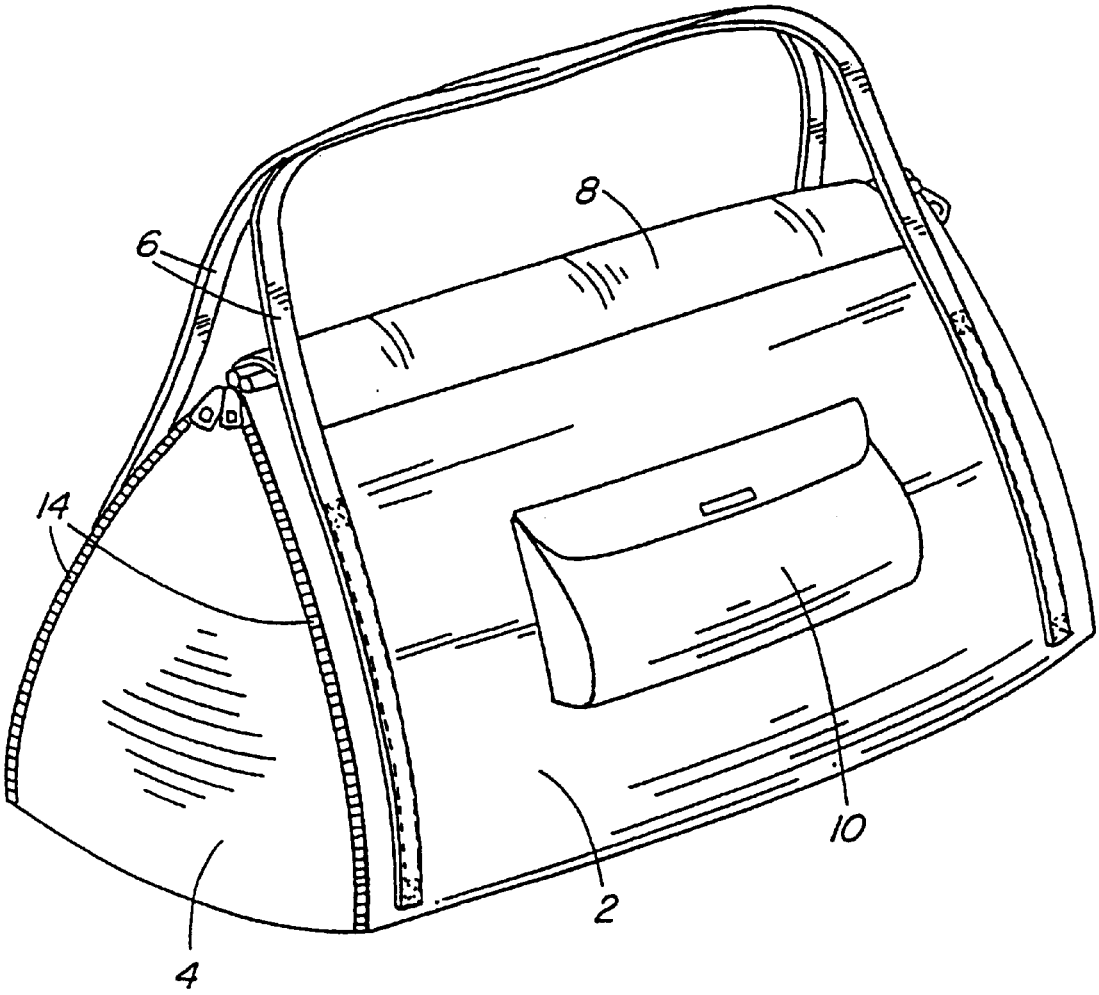
FIG. 2 is a perspective view of a sports bag in the closed configuration according to a second embodiment of the invention.

The sports bag shown in FIG. 2 is in the closed configuration with side walls (2) and end walls (4) hinged upwardly from the base (1) (see FIG. 4) and connected together by zippers (14). The handles (6) are of a length which extends the loop further along the length of the side walls (2) than in the embodiment shown in FIG. 1. The handles (6) facilitate both hand-held transport of the bag and over-the-shoulder carrying. In this embodiment, the end walls are straight at the edges which abut the side walls, so that the end walls are essentially triangular in shape. At the base of the zippers, a tab (not shown) may be placed on the exterior surface of the bag, which tab may be grasped for stability to assist in zipping the side walls to the end walls.

Figure 3:
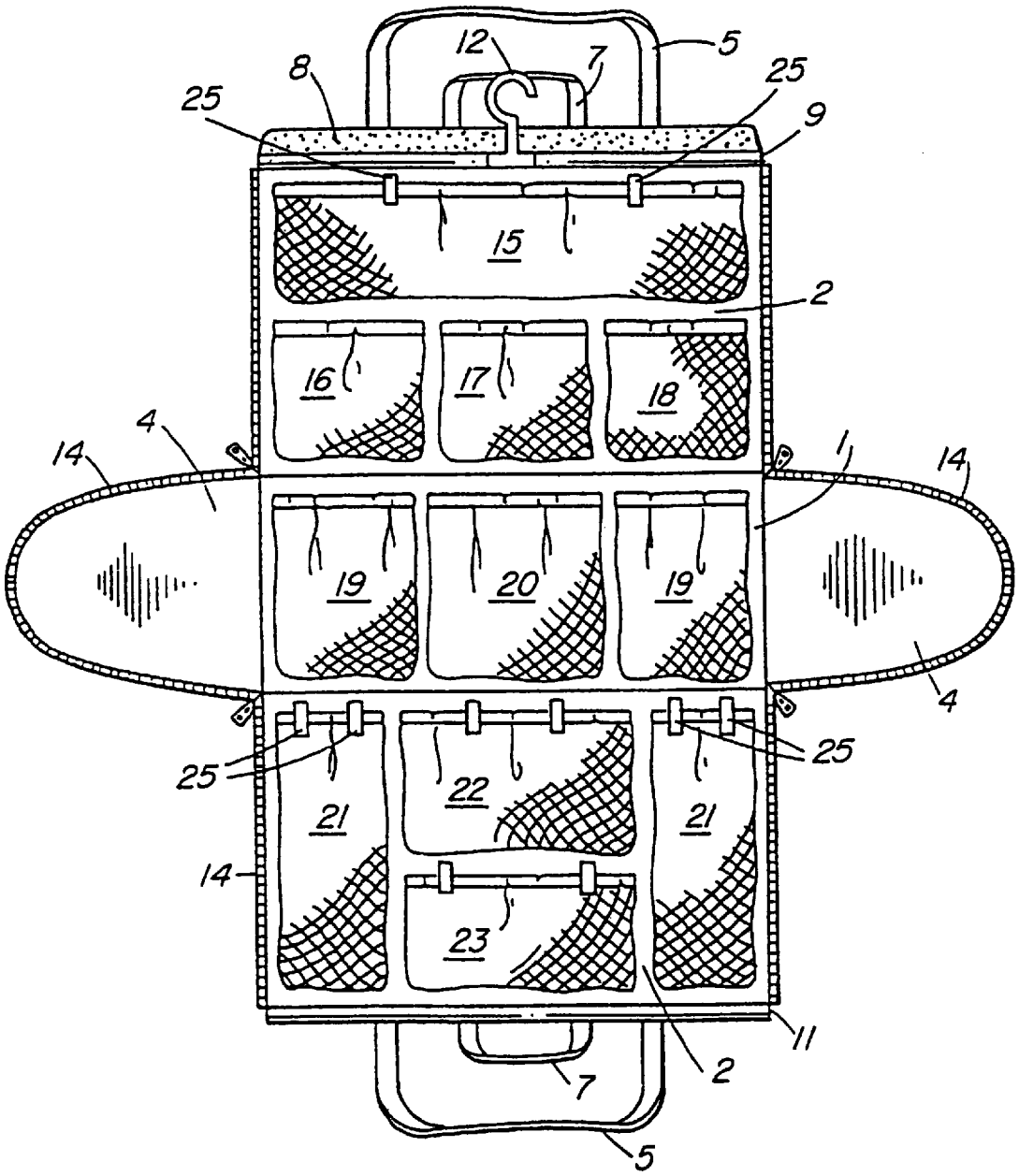
FIG. 3 is a front view of the sports bag in the planar configuration according to the first embodiment of the invention.

FIG. 3 shows the sports bag of FIG. 1 in an opened configuration so that the side walls (2) and end walls (4) are co-planar with the base (1). Hanger loop (12) is disposed at the distal end of one of the side walls (2) to allow the bag to be hung vertically from a hook or rod. Pockets (15–23) made of a mesh nylon fabric are disposed on the interior surfaces of the side walls (2) and base (1) which allow for the insertion of items of hockey equipment in a predetermined order and arrangement. Pockets may either be elasticized along the opening side, or may be closed with velcro tabs (25). Rigid members (9), (11) are located at the distal edges of the side walls. The uppermost rigid supporting member (9) and the hanger loop (12) may be connected to each other.

Figure 4:
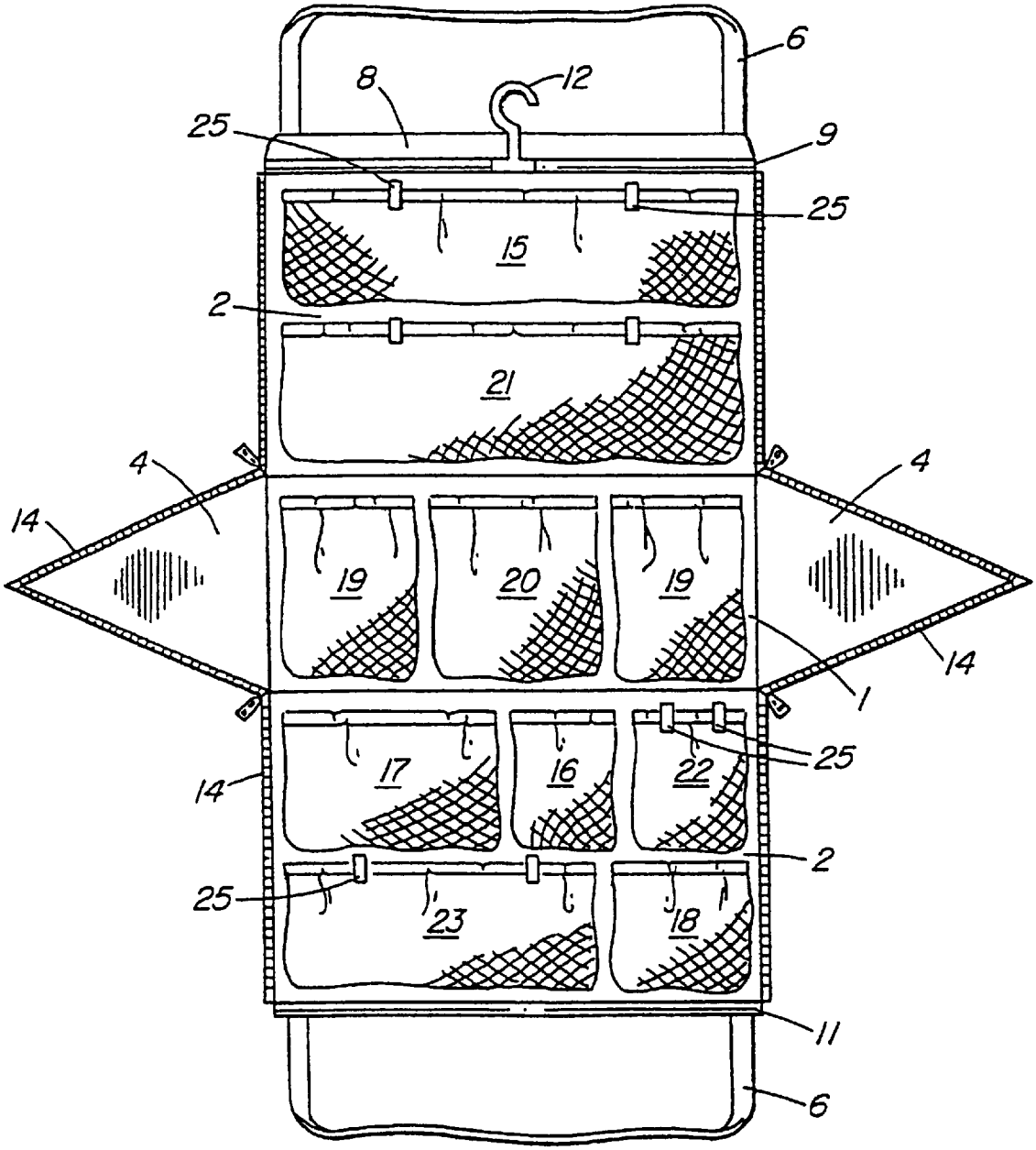
FIG. 4 is a front view of the sports bag in the planar configuration according to the second embodiment of the invention.

FIG. 4 shows the sports bag of FIG. 2 in the opened (planar) configuration. A different arrangement of the interior pockets is illustrated. Again, velcro tabs may be used to ensure closure of the pockets and to help keep the contents of the pockets contained.

In FIGS. 3 and 4, pockets may be sized to accommodate items such as shoulder pads (pocket 15), elbow pads (pocket 16), gloves (pocket 17), miscellaneous items (pocket 18), skates (pocket 19), a helmet (pocket 20), shin guards (pocket 21), neck guard (pocket 22), and hockey pants (pocket 23). Paired items which may be stored together in a pocket, such as shin guards (pocket 21, FIG. 3), may alternatively be stored separately (pockets 21, FIG. 4).

In an alternative embodiment, the pockets are individually labelled with the names of the individual items of sports equipment to be retained therein. Also, the open end of each pocket may be closable with a zipper or velcro, or may be elasticized to ensure that the item contained therein is held securely, but is easily accessible without the extra step of deploying a zipper or velcro closure. Optionally, a pocket may have an opening on a side edge instead of at the top edge, which may be advantageous for access to the contents of the pocket. Such a side opening pocket may also be closable with a zipper or velcro, or may be elasticized. Side access would prevent the contents of the pocket from falling out when the bag is closed, particularly if, in the closed configuration, the opening of the pocket would have been directed toward the base, such as pockets 21–23 in FIG. 3.

Preferably, the pockets are arranged for optimization of space and weight distribution within the bag. Various arrangements of the pockets are anticipated by the invention, and the invention is not limited to the pocket arrangements of the illustrated embodiments. Heavier items such as skates and a helmet may be kept in pockets on the interior surface of the base of the bag, whereas lighter articles of clothing such as hockey pants can be kept in pockets near the distal end of the side wall. Additionally, it is preferable that items are balanced within the bag so that one end will not be heavier than another.

A rigid member (9), such as an elongate rod, is provided longitudinally along the edge of the side wall having the hanger, and a rigid member (11) may optionally be provided on the corresponding distal edge of the other side wall, to facilitate hanging the bag vertically in a planar formation and to avoid buckling. The uppermost rigid member (9) also serves to distribute the weight of the equipment across the length of the distal edge of the side wall when the bag is hung up, thereby reducing tearing of the material. These rigid members, as well as the hanger itself, may be made detachable from the bag. Alternatively, the rigid member (9) or members (9), (11) may be telescopically retractable to reduce bulkiness.

The size of the bag may vary, depending on the particular equipment to be contained therein. For example, young athletes have smaller sized equipment which would not require as much storage space as the equipment intended for a mature (e.g. adult) athlete. In a further embodiment, a smaller sized bag is provided for referees and coaches, with pockets specialized for items of clothing and equipment required by these individuals.

While particularly suitable for hockey equipment, modified versions of the bag would be suitable for other sports, such as baseball and football, or athletic activities such as track, or even for activities such as water sports, where wet equipment and accessories (such as towels) need storing or transporting.

In summary, the sports bag of the present invention thus assists in organization of equipment within the bag and promotes moisture evaporation from the items inside the bag without removal of the items from the bag.

I claim:

1. A sports bag for promoting evaporative drying of items contained therein, the sports bag comprising:

a) a substantially rectangular base;

b) first and second side walls hingedly connected to respective opposite side edges of the base;

c) first and second end walls hingedly connected to respective opposite end edges of the base;

the side walls and end walls being formed of a flexible material and, in a first configuration, the base, side walls and end walls are co-planar, and, in a second configuration, the side walls and end walls extend upwardly from the base, and edges of the end walls are joined to adjacent edges of the side walls via co-operating separable fastening means;

i) a plurality of pockets for retaining items of sports equipment and clothing disposed on interior surfaces of the base and side walls, the pockets comprising a moisture- and air-permeable material which permits air to circulate therethrough, the pockets being dimensioned and arranged to facilitate storage, balancing and sorting of items of sports equipment;

ii) top closure means to releasably connect distal edges of the side walls, thereby enclosing the interior surface of the bag when in the second configuration; and iii) a hanger mechanism connected to the distal edge of the first side wall, the hanger mechanism having a first rigid member adapted to extend along the distal edge of the first side wall, and a centrally located hanger loop, said rigid member being detachable;

whereby the sports bag may be suspended vertically by the hanger loop when in the first configuration to allow for evaporative drying of items within the pockets.

2. A sports bag according to claim 1, wherein the hanger loop is connected to the first rigid member.

3. A sports bag according to claim 1, further comprising a second rigid member adapted to extend along the distal edge of the second side wall.

4. A sports bag according to claim 1, wherein the pockets are openable at the edge nearest the distal edge of the first side wall.

5. A sports bag according to claim 1, further comprising carrying means disposed on the exterior surface of the bag to facilitate hand-held transport of the bag when in the second configuration.

6. A sports bag according to claim 5, wherein the carrying means comprises two flexible loops attached to respective side walls of the bag.

7. A sports bag according to claim 1, further comprising a separable shoulder strap.

8. A sports bag according to claim 7, wherein the length of the shoulder strap is adjustable.

9. A sports bag according to claim 1, wherein the side walls are rectangular in shape and the end walls have three sides.

10. A sports bag according to claim 9, wherein the two edges of each end wall which are not attached to the base are curved.

11. A sports bag according to claim 1, wherein the co-operating separable fastening means is a zipper.

12. A sports bag according to claim 1, wherein the top closure means is a co-operating separable fastener extending along the distal edge of the side walls.

13. A sports bag according to claim 12, wherein the co-operating separable fastener extending along the distal edge of the side walls is a velcro flap.

14. A sports bag according to claim 1, wherein some or all the pockets are closable with a co-operating separable fastener.

15. A sports bag according to claim 14, wherein the co-operating separable fastener for closing the pockets comprises velcro.

16. A sports bag according to claim 1, wherein the pockets are comprised of mesh nylon material.

17. A sports bag according to claim 1, wherein the pockets are individually shaped to retain a specific item of sports equipment or clothing.

18. A sports bag according to claim 17, wherein one or more of the pockets is labelled or coded to denote the specific item to be retained therein.

19. A sports bag according to claim 17, wherein pockets for bulky items are located in the base or on portions of the side walls proximal the base.

20. A sports bag according to claim 1, further comprising an outer pocket disposed on the exterior of a side wall.

21. A sports bag according to claim 1, wherein the bag is adapted for use in transport and storage of hockey equipment.

* * * * *